United States Patent [19]

Sato et al.

[11] 4,141,644

[45] Feb. 27, 1979

[54] CORONA DISCHARGE MEANS IN AN IMAGE FORMATION APPARATUS

[75] Inventors: Tadashi Sato, Kokubunji; Akiyoshi Torigai, Machida; Toshirou Kasamura, Kawasaki; Hidetoshi Tanaka, Musashino, all of Japan

[73] Assignee: Canon Kabushiki Kaisha, Tokyo, Japan

[21] Appl. No.: 793,851

[22] Filed: May 4, 1977

[30] Foreign Application Priority Data

May 21, 1976 [JP] Japan ..... 51/58707

[51] Int. Cl.[2] ..... G03G 15/00

[52] U.S. Cl. ..... 355/3 CH; 355/3 SC; 355/14

[58] Field of Search ..... 355/3 SC, 3 CH, 14; 96/1 C; 250/324–326; 361/225

[56] References Cited

U.S. PATENT DOCUMENTS

| | | | |
|---|---|---|---|
| 3,867,026 | 2/1975 | Ogawa | 355/8 |
| 3,898,085 | 8/1975 | Suzuki et al. | 355/3 SC |
| 4,021,109 | 5/1977 | Tanaka et al. | 355/3 SC |

*Primary Examiner*—R. L. Moses

*Attorney, Agent, or Firm*—Fitzpatrick, Cella, Harper & Scinto

[57] ABSTRACT

This specification discloses an invention relating to the relationship between a latent image bearing member such as screen-like photosensitive medium and a corona discharger used to form a latent image on the latent image bearing member. More particularly, the corona discharger is divided into a plurality of dischargers so that when the sum of the length of the corona discharger for the formation of the latent image and the length of the latent image bearing member is greater than the length in the direction of movement of an endless support member supporting the latent image bearing member, the plurality of dischargers may selectively discharge corona in accordance with the rotational position of the latent image bearing member. By this, the latent image bearing member may be prevented from being dually charged and the length of the latent image bearing member may be minimized to contribute to reduction in size of the image formation apparatus.

7 Claims, 24 Drawing Figures

CORONA DISCHARGE MEANS IN AN IMAGE FORMATION APPARATUS

BACKGROUND OF THE INVENTION

1. Field of the Invention

This invention relates to corona discharge means in an apparatus wherein a latent image is formed on a latent image bearing member and the latent image is modulated and transferred to other member to thereby form an image. More particularly, the invention relates to corona discharge means in an image formation apparatus which enables reduced size of the latent image bearing member and higher speed of image formation in compliance with the reduced size of the image bearing member.

2. Description of the Prior Art

Apparatus in which a latent image is formed on a latent image bearing member, to thereby provide an image, include those using the electrophotographic method. Some of these apparatuses using the electrophotographic method employ the well-known layered photosensitive medium and others employ the screen-like photosensitive medium having a number of fine through-openings (hereinafter simply referred to as the screen). The formation of latent image using such screen is disclosed in U.S. Pat. No. 3,680,954, U.S. Pat. No. 3,582,206, U.S. Pat. No. 3,645,614 and our U.S. application Ser. No. 480,280, now abandoned. These methods of latent image formation using the screen include those in which modulation of ion flows, from one and the same latent image formed on the screen, can be effected a plurality of times.

SUMMARY OF THE INVENTION

It is an object of the present invention to reduce the size of the apparatus for forming a latent image by the use of the latent image bearing member as described above. It is another object of the present invention to minimize the latent image bearing member if it is in the form of a drum, thereby expediting the stabilization during rotation of the image bearing member and increasing the speed of image formation. It is still another object of the present invention to reduce the diameter of the latent image bearing member independently of the length of the corona discharger, thereby reducing the size of the entire apparatus and increasing the speed of image formation.

To achieve the above objects of the present invention, the sum of the length of a first corona discharger acting on the latent image bearing member for the formation of latent image thereon and the length of the latent image bearing member is set so as to be greater than the length in the direction of movement of an endless support member supporting the latent image bearing member. In the conventional apparatus, it has been customary that the latent image bearing member passes only once with respect to the aforementioned corona discharger during the latent image formation. According to the present invention, however, part of the latent image bearing member may be concerned with the corona discharger two times, whereby the endless member may be reduced in length by a corresponding amount, as compared with the conventional apparatus in which the endless member is concerned with the corona discharger only once.

In carrying out the above-described construction, it is necessary to prevent the finished latent image on the image bearing member from being irregularized or broken down by being again subjected to corona discharge. The present invention divides the corona discharger into a plurality of sub-dischargers in accordance with the rotational or angular positions of the latent image bearing member to thereby enable the corona discharger to operate in accordance with the finished latent image position of the image bearing member. More specifically, when the finished latent image comes to the position of the corona discharger, one of the sub-dischargers corresponding to that latent image stops operating, whereby the latent image bearing member may be prevented from being again subjected to the corona discharge.

The latent image bearing member is not restricted to the screen described above, but there are other photosensitive mediums of the type which may form a resistance pattern by combination of charging and exposure, or photosensitive mediums for TESI. Before the invention is described by taking the above-described screen as an example and with respect to the prior art and the embodiments of the present invention, the construction of the screen which permits retention copying and the process of latent image formation using the various illustrative screens will first be discussed. The screen is not restricted to the illustrated examples, but it is of course possible to use the known screen such as the one disclosed in the aforementioned U.S. patents.

The term "primary electrostatic latent image" used herein refers to an electrostatic latent image formed on the screen by a predetermined process of latent image formation, and the term "secondary latent image" refers to a latent image formed on a chargeable member by modulating ion flows by the primary latent image on the screen. The term "retention copying" means the production of a plurality of visible images from one and the same primary latent image.

The invention will become more fully apparent from the following detailed description thereof taken in conjunction with the accompanying drawings.

DESCRIPTION OF THE PREFERRED EMBODIMENTS

Figure 1:
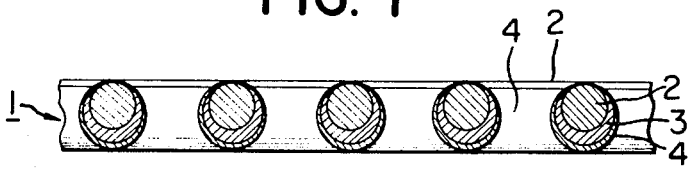
FIG. 1 is an enlarged, fragmentary, cross-sectional view of an illustrative screen.

FIG. 1 schematically shows an enlarged, fragmentary cross-section of the screen used with the present invention. The screen 1 has conductive member 2, a photoconductive member 3 and an insulative surface member 4. The insulative surface member 4 exists on one side of the screen 1 and also in opening portions of the screen, while the conductive member 2 exists on the other side of the screen and in the state of being exposed from the other member layers.

An example of the method forming the screen 1 will now be described. The photoconductive member 2 may be formed by knitting thin metal wire into a metal net or by etching a flat metal plate to form fine openings through the flat plate. The photoconductive member 3 may be formed by using conventional photoconductive substances and depositing these photoconductive substances on one side of the conductive member 2 through the vacuum evaporation technique, the sputtering technique, the spray coating technique or the like. As regards the insulative member, substances available therefor include resin materials having a high electrical resistance and high charge retaining characteristic. These substances may be provided on the photoconductive member 3 pre-formed on the conductive member 2, by the spray coating technique or the vacuum evaporation technique. The screen 1 has the conductive member 2 exposed on one side thereof, but if the photoconductive member 3 and the insulative member 4 extend even to cover the exposed portion, a further conductive member may be overlaid thereon or the covering members may be ground and removed by the use of a grinding agent.

Reference will now be had to FIGS. 2 to 5 to describe the image formation process using the screen 1 of FIG. 1. In the process to be described below, it is assumed that the photoconductive member 3 is formed of selenium (Se) with holes as the chief carrier, or other photoconductive substance such as Se-alloy.

Figure 2:
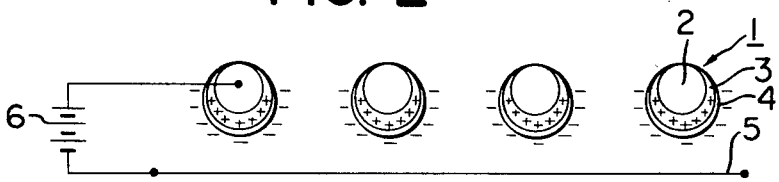
FIGS. 2 to 4 illustrate the process of primary latent image formation using the screen of FIG. 1.

FIG. 2 illustrates the state of the screen 1 having been charged to the negative (−) polarity by the step of primary voltage application. Designated by 5 is the corona wire of a corona discharger which is charging means, and 6 the high voltage source section of the wire 5. By the described charging, a layer of charge of the positive (+) polarity which is opposite to the polarity of the primary charge is formed in the neighborhood of the insulative member 4 by the holes being introduced therein from the conductive member 2.

Figure 3:
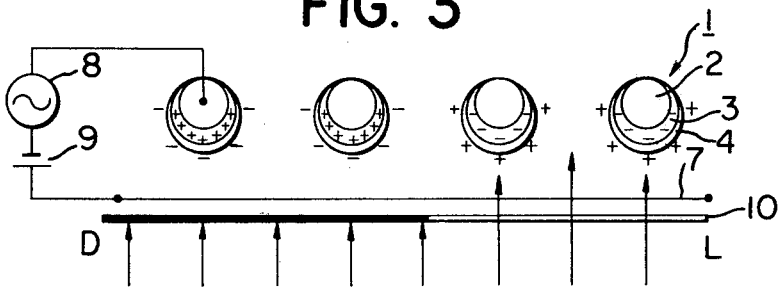

FIG. 3 illustrates the state of the screen 1 having been subjected to simultaneous application of image light and secondary voltage after the above-described primary voltage application. The step of secondary voltage application is carried out by applying to a corona discharger an AC voltage with a DC voltage of the positive polarity superimposed thereon. Designated by 7 is a corona wire, 8 the AC voltage source section of the wire 7, 9 the superimposing voltage source for the voltage source section 8, and 10 an original image having a dark (black) region D and a light (white) region L. Arrows indicate the light rays from the light source. In the step of secondary voltage application, a bias voltage of the positive polarity is superimposed on the AC voltage so that the surface potential of the insulating member 4 assumes substantially the positive polarity. As the result, in the light region subjected to the image light, the photoconductive member 3 becomes conductive so that the charges created by the previous step are removed and the surface potential of the insulative member 4 assumes the positive polarity. In the dark region, however, the surface potential of the insulative member 4 remains negative with the aid of the aforementioned charge layer in the photoconductive member 3.

Observing the charged condition on the insulative member 4 of the screen 1 provided by the above-described step, it is seen that the portions of the member 4 facing the corona wire 7 assume the positive polarity earlier and the opening portions are varied later than that. Thus, in the light region of the image, the potential becomes gradually higher from the exposed side to the other side of the conductive member 1 of the screen 1.

Figure 4:
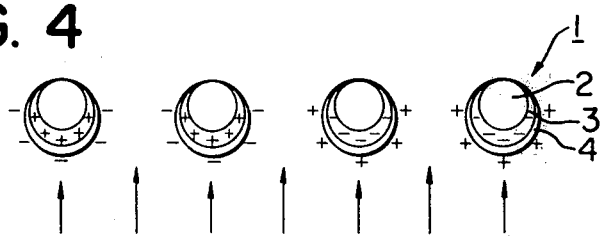

FIG. 4 illustrates the state of the screen 1 having a primary latent image formed thereon by being subjected to the step of whole surface illumination after the above-described step. Arrows indicate uniform illuminating light. Depending on the covering technique for the photoconductive member 3, the thickness thereof may smoothly decrease toward the opening portions. Therefore, in the dark region of the screen 1, the aforementioned charge layer may be sharply varied in accordance with the surface charge, as the result of which the potential on the insulative member is gradually varied for a high negative potential from the exposed side toward the other side of the conductive member 2 of the screen.

Figure 5:
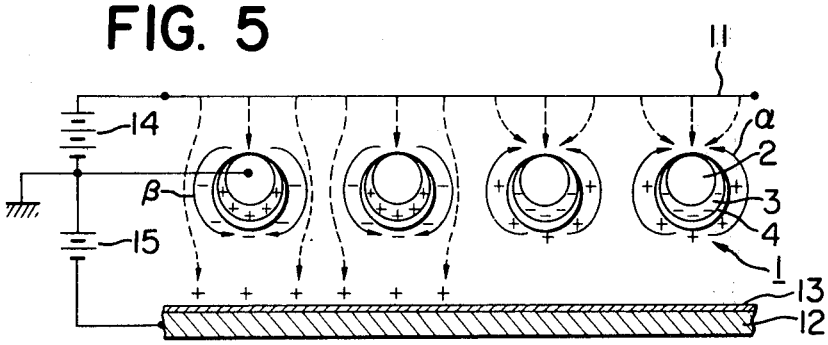
FIG. 5 illustrates the process of secondary latent image formation.

FIG. 5 illustrates the step of secondary latent image formation. Designated by 11 is a corona wire for generating modulation corona ions, 12 an electrode opposed to the corona wire 11, and 13 a recording member supported on the electrode 12 and disposed at a suitable distance of the order of 1 to 10 mm from the screen 1. Designated by 15 is the voltage source section of the opposed electrode 12, and the polarity of each voltage source section is set such that a potential difference is created in the direction from the corona wire 11 toward the opposed electrode 12. In the above-described state, when flows of corona ions occur from the corona wire 11 to the recording member 13, electric fields as indicated by solid lines $\alpha$ are formed on the light region of the screen by the charges on the insulative member 4 to block the ion flows while, on the dark region of the screen, electric fields as indicated by solid lines $\beta$ are formed to accelerate the ion flows. If, in the said light region, the entire surface of the conductive member 2 is covered, that side of the screen 1 facing the wire 11 is charged with the modulation ions and as the result, the primary electrostatic latent image is negated to bring about inconvenience during retention copying.

The screen 1 now under discussion enables retention copying, and this would be attributable to the primary latent image formed with a smooth variation in potential on the insulative member of high charge retaining capability existing from one side to the opening portions of the screen 1, and in addition, to the effect of the conductive member 2 of the screen 1 which absorbs any excess corona ion flow during modulation which will disturb the primary latent image.

The invention will now be described by the use of the above-described screen.

Figure 6:
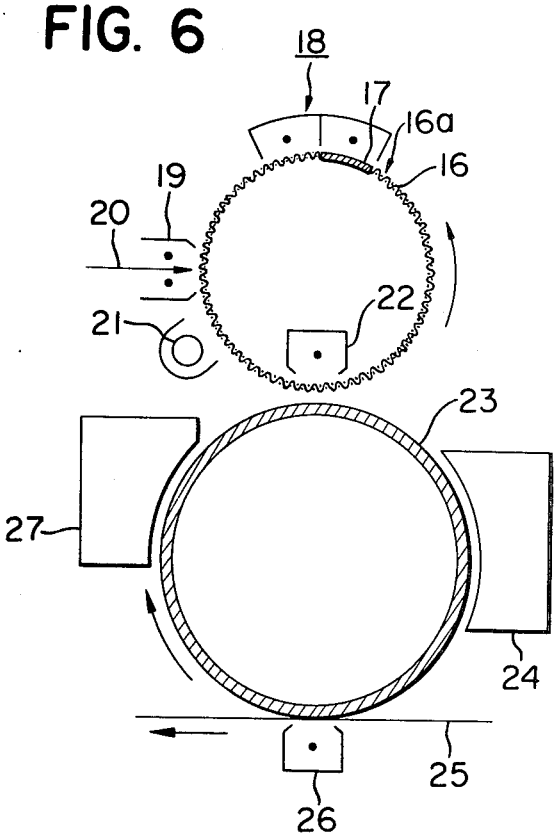
FIG. 6 is a schematic illustration of an embodiment of the apparatus to which the invention is applied.
Figure 7:
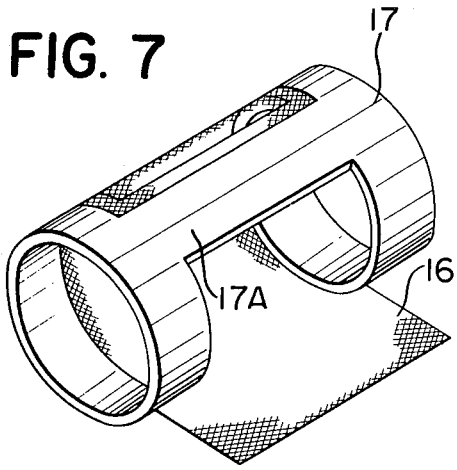
FIG. 7 is a perspective view of a drum-shaped frame member over which the screen is stretched.
Figure 8A:
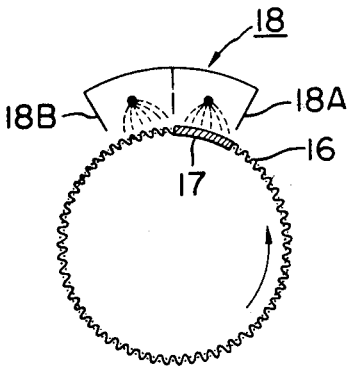
FIGS. 8*a* to 8*g* illustrate the process of primary voltage application according to the present invention.
Figure 8B:
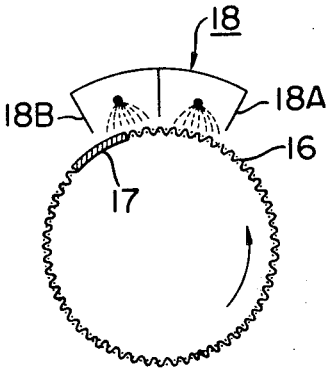
Figure 8C:
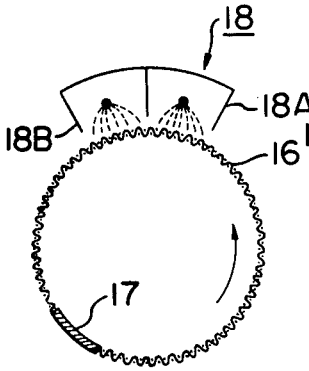
Figure 8D:
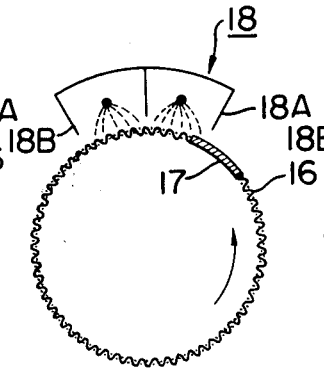
Figure 8E:
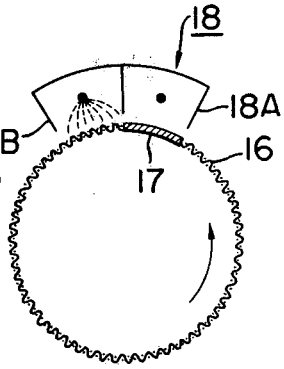
Figure 8F:
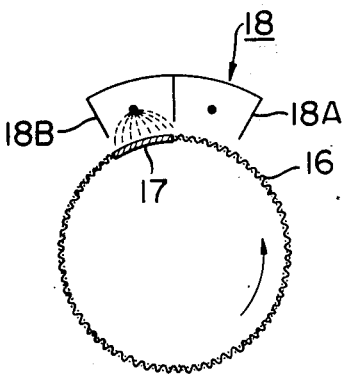
Figure 8G:
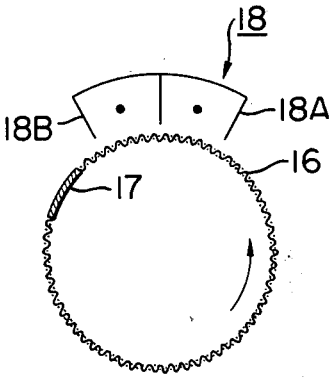

FIG. 6 shows an embodiment of the apparatus using the above-described screen to form an image thereon. This apparatus is designed such that a secondary latent image is formed on an insulative drum and then developed, whereafter the developed image is transferred to a transfer medium (plain paper). Designated by 16 is the screen which may be provided by forming the above-described screen 1 into a drum shape with the exposed portions of the conductive member facing inwardly. The formation of the screen 16 into the drum shape may be accomplished by attaching the screen 16 to a frame member 17 which is an endless support for the screen, as shown in FIG. 7, by the use of an adhesive agent and in the manner as shown. In FIG. 6, there is seen a corona discharger for applying the primary voltage, a corona discharger for applying the secondary voltage, arrows 20 indicating the image light, and a lamp 21 for the whole surface illumination. The screen 16 forms thereon a primary electrostatic latent image while it is rotated in the direction of arrow. By the primary latent image so formed, the corona ions from a corona discharger 22 are modulated on the insulative drum 23 to thereby form a secondary latent image on the drum. The secondary latent image on the insulative drum 23 rotating in the direction of the arrow is developed by a developing device 24, and the toner image resulting from the development is later transferred to transfer paper 25 by the electric field of a discharger 26. After the image transfer, the insulative drum 23 is cleaned by cleaning means 27 to remove any residual toner, whereby the drum 23 becomes ready for another cycle. In the apparatus described above, in case the circumferential length of the frame member 17 supporting the screen is shorter than the length of the screen plus the length of the corona discharger 18 for the application of primary voltage, the state of the screen 16 after the application of primary voltage thereto will be such that the leading end portion 16*a* of the screen 16 is again concerned with the corona discharger 18. No particular problem would occur if the apparatus were of the type in which formation of the primary latent image and formation of the secondary latent image take place simultaneously. However, (1) where it is desired to form a plurality of secondary latent images from one and the same primary latent image, (2) where a secondary latent image is formed when the screen passes by the discharger 22 for the second time, because the speed of image formation differs between primary latent image and secondary latent image, and (3) where a secondary latent image is formed when the screen passes by the discharger 22 for the second time as in the case (2) above, because the bias voltage applied to the screen differs between the formation of primary latent image and secondary latent image, the screen 16 comes to be concerned with the primary voltage application discharger 18 two or more times after the primary latent image has been formed on the screen. Therefore, if the discharger 18 is still operating until the leading end of the screen 16 has passed by that discharger, primary voltage application would again be effected on the primary latent image once completely formed at the leading end portion of the screen 16. By this, the portion of the primary latent image again subjected to the primary voltage application would be broken down. Where it is desired to reduce the diameter of the screen 16 and thus the size of the entire apparatus, the above-described problem will occur, but the present invention overcomes such problem by operatively dividing the primary voltage application discharger, namely, that corona discharger for applying a voltage to the latent image for the first time, into a plurality of sub-dischargers. This will hereinafter be described by reference to FIG. 8. FIG. 8 sequentially illustrates the step of primary voltage application according to the present invention. FIG. 8*a* shows the start of the rotation of the screen 16 and the start of application of the primary voltage, and in this case the discharger on the side 18B need not be operated. FIGS. 8*b* to 8*d* illustrate the progress of the primary voltage application by the discharger 18 with the rotation of the screen 16. When the position of FIG. 8*e* is reached, namely, when the leading end of the screen 16 again comes to the discharger 18, the sub-discharger 18A adjacent to the leading end of the screen stops discharging and only the sub-discharger 18B remains operative to continue voltage application. Further, when the application of primary voltage to the screen 16 is finished in the position of FIG. 8*f*, the sub-discharger 18B also stops discharging as shown in FIG. 8*g*. Thereby, the primary latent image on the screen 16 is exempted from unnecessary application of primary voltage, so that the latent image is never broken down. The screen 16 further continues to rotate in the direction of arrow from the position of FIG. 8*g*, whereby a secondary latent image is formed on the screen by the discharger of FIG. 6. Where the formation of primary latent image is followed by ion modulation, it will be obvious that the discharging of the secondary voltage application discharger 19, the application of image light and the whole surface illumination do not take place.

Figure 9:
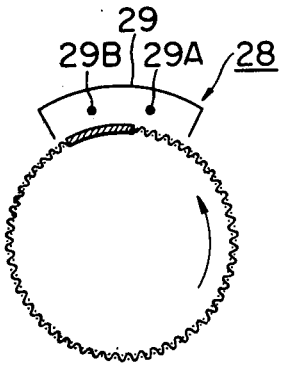
FIGS. 9 to 11 illustrate further embodiments of the discharger used for the application of primary voltage.

In the embodiment described above, the corona discharger 18 has a shield plate for separating it into two subdischargers within a shield plate, whereas no such separating shield plate need be provided within the shield plate 29 of a corona discharger 28 as shown in FIG. 9, but sub-dischargers 29A and 29B may be disposed simply side by side and these two sub-dischargers 29A and 29B may be operated simultaneously or selectively.

Figure 10:
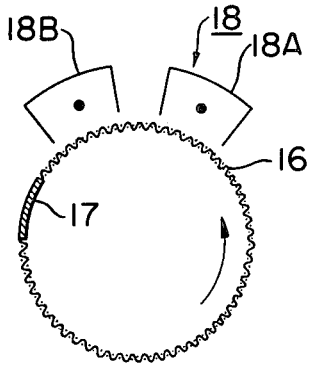
Figure 11:
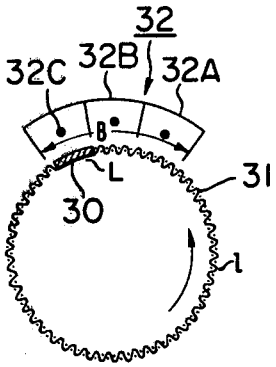

The manner of dividing the corona discharger 18 is not restricted to the FIG. 8 arrangement in which the separating shield plate is formed integrally with the outer shield plate, but separate corona dischargers may be individually provided as shown in FIG. 10. Also, the number of divisions of the discharger is shown as two in the above-described embodiment, whereas division into three or more is also possible. By increasing the number of divisions to set the width of each sub-discharger to a narrow one, it is also possible to shorten the non-image bearing portion 30 of the drum as shown in FIG. 11, thereby further reducing the circumferential length of the drum-shaped frame member. In FIG. 11, which shows in cross-section the drum-shaped screen and the primary voltage application discharger, the screen 31 is provided with respect to the frame member, and the primary voltage application corona discharger 32 comprises three sub-dischargers 32A, 32B and 32C which are individually operable. As the number of such individually operable sub-dischargers is increased, the support member for the screen may be made smaller in size by the present invention. While the screen has been shown to be stretched over a drum-shaped frame member which is an endless support member, the screen may also be a web-like screen or may be stretched over a web-like support member which is rotatable. The effect of the invention will be greater as the first discharger for the latent image bearing member like a screen is longer with respect to the screen. For example, suppose a construction in which the circumferential length 1 of the screen 16 is 40 cm and each of the sub-dischargers 18A and 18B forming the discharger 18 is designed to a length 5 cm, so that the total length B of the discharger 18 is 10 cm. Also, assume that when the peripheral velocity of the screen is v (cm/sec.), the rising and the falling time of the sub-dischargers 18A and 18B are $t_1$ and $t_2$ (sec.), respectively. In such case, according to the conventional method, the circumferential length L of the drum-shaped frame member 17 for the screen is expressed as:

$$L(cm) = l + B + (t_1 + t_2)v \quad (1)$$

If the rising time $t_1$ and the falling time $t_2$ are 0.2 to 0.3 sec. and the peripheral velocity v of the screen is 12 cm/sec., the diameter D of the drum-shaped frame member 17 may be calculated as 17.4 (cm) from $\pi D = 54.8$(cm). However, by applying the present invention, said total length B becomes B/2 and thus, the diameter D of the drum-shaped frame member 17 becomes 15.8(cm). That is, by dividing the discharger 18 into two, it is possible to reduce the diameter of the support member by approximately 10%. Further, if the number of divisions of the discharger is n, the circumferential length L may be obtained from the following equation:

$$L = l + B/n + (t_1 + t_2 + \ldots t_n)v \quad (2)$$

Consequently, the diameter D of the frame member is:

$$D = l + B/n + (t_1 + t_2 + \ldots t_n)v/\pi$$

The aforementioned dischargers are not restricted to the DC corona discharge type but may also be of the AC corona discharge type or of the type which permits simultaneous application of image light. In the last-mentioned type wherein image light is imparted, a shutter must be provided for the slit portion so as to prevent the leading end portion of the screen, bearing thereon a finished primary latent image, from being again exposed to light.

Figure 12:
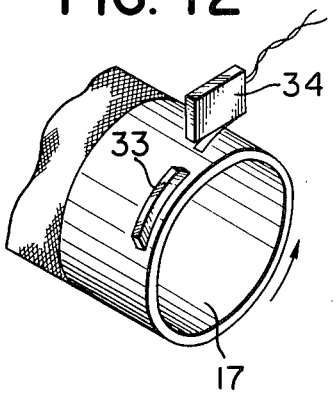
FIGS. 12 and 13 are perspective views of the detecting section and showing examples of the control for actually effecting the divisional corona discharge by using the corona discharger of the present invention.
Figure 13:
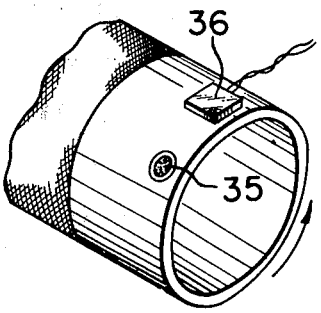

Description will now be made of an embodiment of the corona discharger control for carrying out the present invention. FIGS. 12 and 13 show embodiments in which the corona discharger is divided into two as described, and particularly show a signal detecting section. The embodiment of FIG. 12 comprises a combination of a microswitch and a cam, and the embodiment of FIG. 13 comprises a combination of a magnetic member and a magneto-sensitive member. In FIG. 12, reference numeral 33 designates a cam secured to the frame member 17. Designated by 34 is a microswitch secured to the main body of the apparatus. The divisional control of the corona discharge is effected by the cam 33 actuating the microswitch. In FIG. 13, reference numeral 35 designates a magnet secured to the frame member 17 as is the cam 33, while reference numeral 36 designates magnetism detecting means such as Hall IC secured to the main body of the apparatus. The signal detecting section need not always be located on the end of the peripheral portion of the frame member but may also be provided on one side of the frame member as in the conventional photosensitive medium. In the design of the frame member as shown in FIG. 7, the signal detecting section may of course be provided on a connector strap 17A connecting together the opposite cylindrical end portions.

Figure 14:
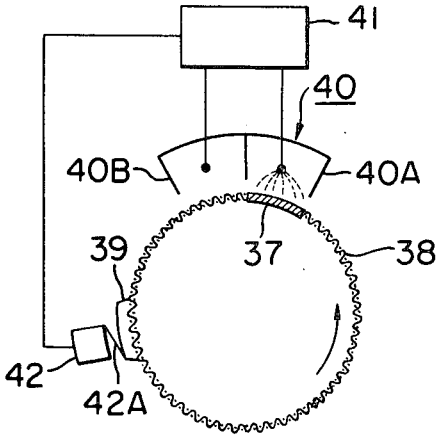
FIGS. 14 to 16 illustrate the control as actually effected.
Figure 15:
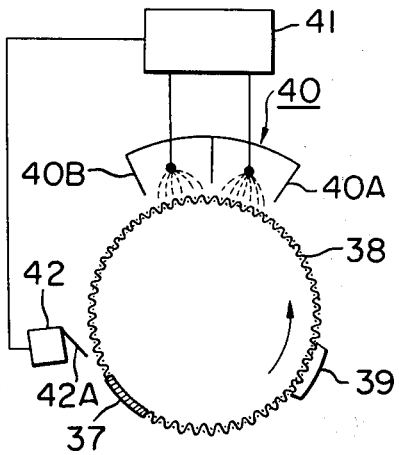
Figure 16:
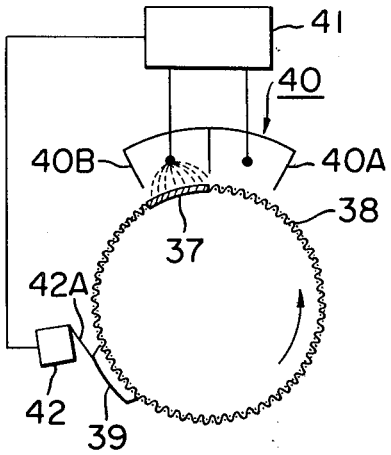
Figure 17:
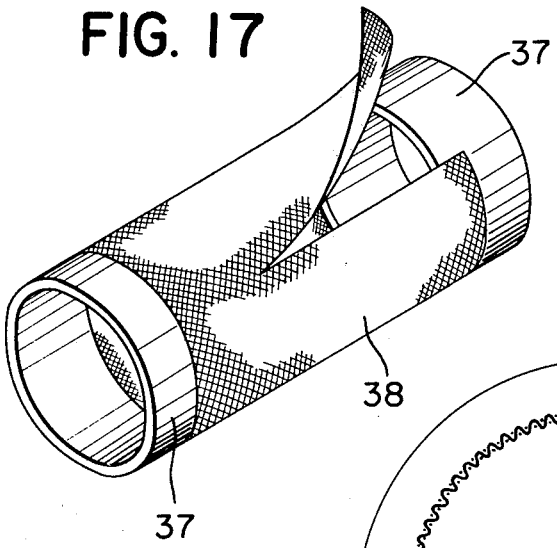
FIG. 17 is a perspective view showing a further form of the screen to which the present invention is applicable.
Figure 18:
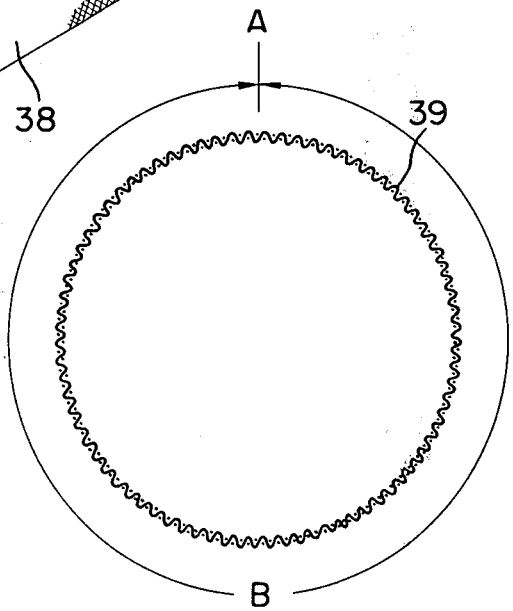
FIG. 18 illustrates the image bearing region provided when an endless screen is used.

FIGS. 14 to 16 illustrate an example of the control. The detecting means comprises a cam-microswitch combination as already described in connection with FIG. 12. FIG. 14 refers to the case where application of the first corona discharge has been started for the formation of primary latent image. In FIG. 14, reference numeral 37 designates a frame member, 38 a screen, 39 a cam secured to the surface of the frame member as shown in FIG. 12, and 40 a first corona discharger which comprises two individually operable sub-dischargers 40A and 40B. Designated by 41 is a control section which controls the operation of the above-mentioned corona discharger in response to detection signal from the microswitch 42. In FIG. 14, the cam 39 is shown as actuating the microswitch 42, but in this case the corona sub-discharger 40B is not operated while the sub-discharger 40A alone generates corona. As the frame member is further rotated in the direction of arrow as shown in FIG. 15, the detecting arm 42A is disengaged from the microswitch 39, whereupon the corona sub-dischargers 40A and 40B are both operated to effect sufficient corona discharge on the screen 38. Further rotation of the frame member 37 causes the cam 39 to actuate the microswitch, whereupon the sub-discharger 40A alone stops corona discharging. Although not shown, when further rotation brings the detecting arm 42A of the switch 42 out of engagement with the cam 39, the sub-discharger 40B also stops operating. Thus, the screen 38 is substantially subjected to sufficient corona discharge by the large discharger 40, thereby enabling formation of a primary latent image with high potential. That is, the corona discharger of the present invention, as compared with the conventional discharger which has not been subdivided, enables the diameter or the circumferential length of the screen to be smaller than before. This is a very important improvement and as the result, rotation of the photosensitive member is stabilized and the interval between secondary latent images is reduced when retention copying is effected. Describing this by reference to FIG. 6, when the entire surface of the screen 16 is used, sheets of transfer paper 25 are conveyed at an interval corresponding to the circumferential length of the frame member 17, and according to the present invention, the circumferential length of the frame member 17 is shorter than before, so that the interval between the sheets of transfer paper 25 conveyed becomes shorter, thereby enabling the speed of image formation. The present invention is effective not only for the apparatus using an insulative drum as shown in FIG. 6, but also for the image formation apparatus in which secondary latent image is formed on a chargeable sheet such as insulative paper or the like, and the construction of the screen is not restricted to that shown in the above-described embodiment. Further, the endless support member over which the screen is stretched is neither restricted to that shown in FIG. 7, but a frame member comprising two opposite cylindrical frame members connected together by a connector strap disposed inwardly of the screen will also be effective. The screen to which the present invention is applicable may take forms in which the connector strap as shown in FIG. 7 is substantially absent. For example, as shown in FIG. 17, there is an endless screen formed by providing cylindrical frame members 37, which are endless support members, at the opposite ends and by seaming the ends of the screen 38 in the direction of its rotational axis to the cylindrical frame members, or there is a screen formed by stretching an originally endless screen between two frame members. For such screens, if the seam of the screen influences the image formation, such seams may be used as the end of the image, but if there is no fear of such influence or if a seamless screen is employed, any desired location A in the screen 39 may be set as the end of the image as shown in FIG. 18, whereby the region for primary latent image formation may be determined. Where such construction is adopted, continuous images may be formed on the secondary latent image formation member and therefore, sheets of recording medium or transfer paper can be continuously fed, whereby the speed of image formation may be increased as compared with the screen having the connector strap. Also, the formation of continuous image will lead to the usability of rolled recording or transfer paper.

The detector means is not restricted to the illustrated forms, but may also comprise a combination of a light source and a light receiving element or a combination of an ultrasonic wave generator and a sound receiving element, or may be other detector means. Where means like a cam is employed, the time control is also effected by the shape of the cam, but if the detector means used is one which can only detect the point position, it will also be effective to use timer means to set the control time from the detection point. That is, the timer means will be operated by the detection of the point position so that the corona discharge of a predetermined discharger will be controlled in accordance with the operating time.

What we claim is:

1. A corona discharge device for use in an image formation apparatus wherein said device is used in the forming of a primary electrostatic latent image on an image bearing member, and a secondary image is formed on a recording member by the use of the primary latent image, said image bearing member being mounted on an endless supporting member, the improvement comprising:

a plurality of corona electrode means each of which is independently operable to effect corona discharge to said latent image bearing member, wherein the sum of the lengths of said corona means and the latent image bearing member is greater than the length of the supporting member, wherein all said lengths are measured in the direction of movement of said latent image bearing member; and control means for selectively operating all or part of said corona electrode means in accordance with movement of said image bearing member.

2. An improved corona discharge device as claimed in claim 1, wherein said corona electrode means comprise means for sensitizing said latent image bearing member.

3. An improved corona discharge device as claimed in claim 1, wherein said latent image bearing member is an endless screen-like photosensitive member.

4. An improved corona discharge device as claimed in claim 1, wherein said plurality of corona electrode means comprises a plurality of corona discharge electrodes within a single shield member, and wherein when corona discharge is partly effected, a high voltage is selectively applied to said corona discharge electrodes.

5. An improved corona discharge device as claimed in claim 1, wherein said plurality of corona electrode means comprises a plurality of corona discharge electrodes within a single outer shield member and at least one shield member disposed between said discharge electrodes, and wherein when corona discharge is partly effected, a high voltage is selectively applied to said corona discharge electrodes.

6. An improved corona discharge device according to claim 1, wherein said latent image bearing member is a non-endless screen-like photosensitive medium and said endless support member is a drum-shaped support member, and wherein the support member has an intermediate portion extending axially thereof for inconnecting circumferentially spaced ends of axial non-endless screen-like medium.

7. Corona discharge means in an image formation apparatus in which the corona discharge means, having a plurality of electrodes, in the forming of an electrostatic latent image on a latent image bearing member, and in which image formation is effected by the use of the latent image, the improvement residing in that the sum of the length of said corona discharge means acting on said latent image bearing member used for the formation of the latent image and the length of said latent image bearing member is greater than the length in the direction of movement of an endless support member supporting said latent image bearing member, wherein the discharge electrodes of said corona discharge means are simultaneously or individually operated in accordance with the moving position of said latent image bearing member, and wherein the corona discharge means further comprises a plurality of sets of corona discharge devices, each set comprising a shield member and a discharge electrode, and wherein when corona discharge sets are selectively operated.

* * * * *